United States Patent [19]

Komatsu et al.

[11] Patent Number: 4,947,208

[45] Date of Patent: Aug. 7, 1990

[54] PROCESS CARTRIDGE AND IMAGE FORMING APPARATUS USING SAME

[75] Inventors: Teruo Komatsu; Ichiro Ohsawa, both of Yokohama; Shinji Goto; Nobukazu Adachi, both of Tokyo; Takashi Goto, Zushi; Junichi Asano, Kawasaki, all of Japan

[73] Assignee: Canon Kabushiki Kaisha, Tokyo, Japan

[21] Appl. No.: 286,250

[22] Filed: Dec. 19, 1988

[30] Foreign Application Priority Data

Dec. 22, 1987 [JP] Japan ..... 62-324647

[51] Int. Cl.[5] ..... G03G 15/00

[52] U.S. Cl. ..... 355/200; 355/210

[58] Field of Search ..... 355/200, 202, 210, 211, 355/212; 358/300

[56] References Cited

U.S. PATENT DOCUMENTS 4,542,976 9/1985 Kasamura ..... 355/3 R
4,588,280 5/1986 Ogawa et al. ..... 355/3 R
4,616,920 10/1986 Itoigawa et al. ..... 355/212 X
4,634,264 1/1987 Takahashi ..... 355/16
4,702,587 10/1987 Miyoshi ..... 355/200
4,829,334 5/1989 Takamatsu et al. ..... 355/211 X

FOREIGN PATENT DOCUMENTS 0232064 8/1987 European Pat. Off. ..... 355/210
59-002054 1/1984 Japan .
61-292166 12/1986 Japan .

*Primary Examiner*—R. L. Moses
*Attorney, Agent, or Firm*—Fitzpatrick, Cella, Harper & Scinto

[57] ABSTRACT

An image forming apparatus usable with a process cartridge having an improved positioning mechanism between the process cartridge and an optical system of the main assembly of the image forming apparatus. The process cartridge and the optical system are freely movable supported in the main assembly, and positioning portions of the process cartridge and the optical system are abutted to a positioning member fixed to the main assembly of the image forming apparatus.

23 Claims, 6 Drawing Sheets

PROCESS CARTRIDGE AND IMAGE FORMING APPARATUS USING SAME

FIELD OF THE INVENTION AND RELATED ART

The present invention relates to an image forming apparatus of an electrophotographic type, more particularly to an image forming apparatus usable with a process cartridge.

Recently, image forming machines such as laser beam printers which produce high quality images with low noise and another electrophotographic process type image forming apparatus using an LED array and liquid crystal shutter, are widely used.

The output images of those machines are desired to have a further improved image quality and high density of the dot image. Those image output machines are recently used in offices for improvement in efficiency, and therefore, the reduction of the size of the apparatus is strongly desired.

Referring first to FIG. 7, a conventional example of a laser beam printer which is most widely used will be described. The laser beam printer is generally divided into a process cartridge A for executing an electrophotographic process, an optical system B for converting an electric signal from a computer or the like to a light signal and for directing the light signal to the process cartridge A, and transfer material conveying section C for conveying a transfer material such as paper and for fixing the transferred image.

The process cartridge A contains a photosensitive drum 1 for receiving a light signal from the optical system B to form an electrostatic latent image, an exposure lamp 2 for making the surface. potential of the photosensitive drum 1 uniform, a charger 2A for uniformly charging the photosensitive drum 1, a developing device 3 for visualizing the electrostatic latent image with fine resin powder (toner), a cleaner 4 for removing and collecting the toner from the photosensitive drum after the image is transferred to the transfer material 20. Those process means 1, 2*a*, 3 and 4 are contained in the cartridge casing as a unit to constitute a process cartridge A.

The optical system B includes an unshown laser unit such as a semiconductor laser for emitting a laser beam in the form of a small diameter collimated beam, a polygonal mirror 10 rotatable for scanning the photosensitive drum in the direction of the axis thereof with the collimated beam, a scanner motor 11 rotatable at a predetermined speed and an imaging lens system for imaging the laser beam on the photosensitive drum 1. Those elements are contained in a resin housing 14 to constitute a scanner unit 13.

The transfer material conveying section C includes a cassette 21 for containing the transfer materials 20, a pick-up roller 22 for feeding the transfer materials one by one, a registration roller 23 for registration of the toner image on the photosensitive drum 1 and the transfer material, a transfer charger 24 for improving the efficiency of the image transfer, a fixing device 25 for fixing the toner transferred onto the transfer material 20 and guide plates and rollers for conveying and guiding the transfer materials. Those elements are securedly fixed on a frame 26 to guarantee the positional relationship among them.

The image quality and the print accuracy of the laser beam printer are greatly influenced by the correctness of the positional relation among those three constituent elements A, B and C.

In order to assure the relationship, it is conventional that a supporting block 30 having a bearing portion 30-1 for rotatably supporting a shaft of the photosensitive drum 1 of the process cartridge A and a supporting portion 30-2 for supporting the housing 14 of the optical system B are formed as a unit made of resin as shown by the hatching, and that the supporting block 30 is fixed on the frame 26 to guarantee the positional relationship among the transfer material conveying section C, particularly, the transfer material, the photosensitive drum 1 and the scanner unit 13.

According to the above method, the positional accuracy can be accomplished in good order, but involves the following problem. When, for example, the main assembly of the apparatus is of a bivalve type wherein the apparatus is openable about a shaft 41 for the purpose of jam or other conveyance error, of the transfer material or for the purpose of exchanging the process cartridge A, the scanner unit 13 is moved away to be retracted from track L of the rotation of the cartridge casing 5, and then it is mounted to the lower body. Therefore, the main assembly mainly constituted by the upper and the lower body becomes bulky. Therefore, the demand for the small size of the apparatus is not met. If the mirror 15 for folding the laser beam between the scanner unit 13 and the cartridge 5 is disposed above the photosensitive drum 1, the size of the main assembly can be reduced. However, the mirror has to be mounted to the rotating side of the upper part of the apparatus, and therefore, it is easily influenced by vibration, and the positional accuracy is also degrated, with the result of lower image quality. If in order to solve those problems, another element such a vibration preventing member or the like, or the accuracy of the parts is increased, the cost of the apparatus is increased.

SUMMARY OF THE INVENTION

Accordingly, it is a principal object of the present invention to provide an image forming apparatus wherein the process cartridge is accurately positioned relative to the transfer material conveying section, and the optical system is accurately positioned relative to the cartridge, by which the size of the apparatus is small, and that a high quality image can be produced.

According to an embodiment of the present invention, there is provided an image forming apparatus comprising a main assembly including a first body and a second body which is openable, a process cartridge for producing a toner image through an electrophotographic process, optical means for producing light information to be applied to the process cartridge, wherein the optical system and the process cartridge are movably disposed in the main assembly, and a positioning member fixed on the main assembly for positioning the process cartridge and the optical system.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Figure 7:
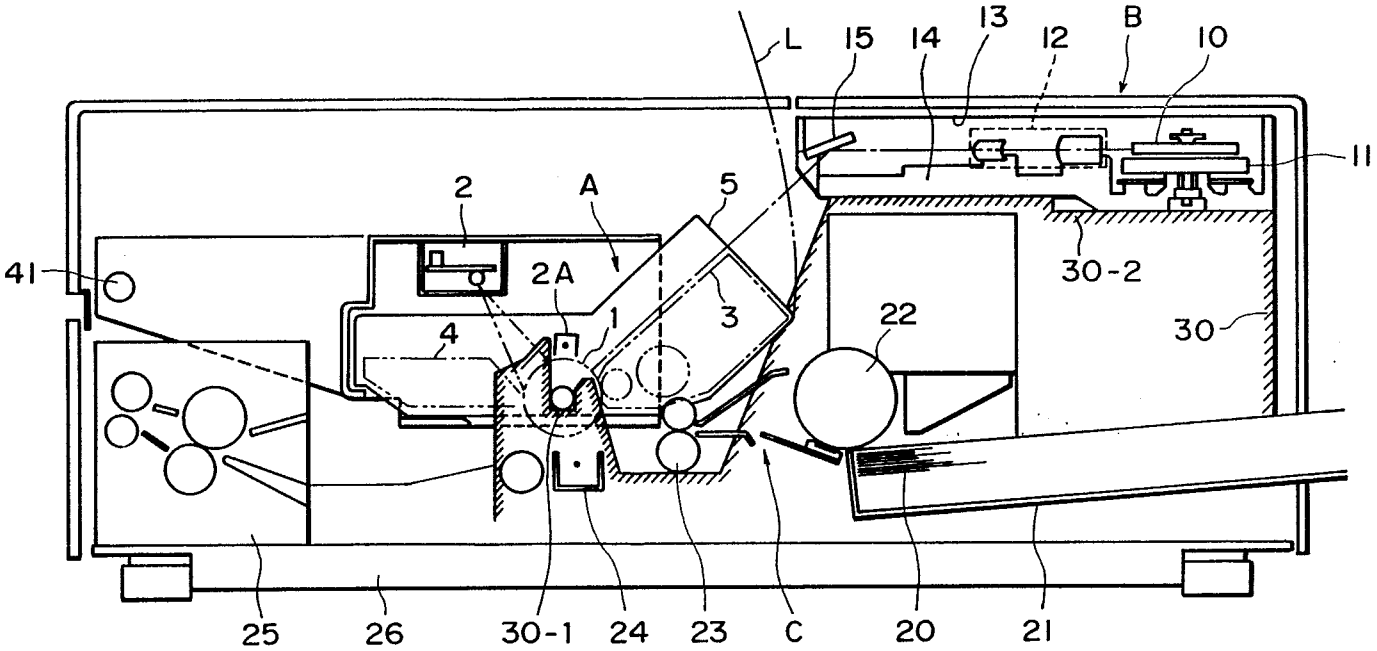
FIG. 7 is a sectional view of a conventional apparatus.
Figure 8:
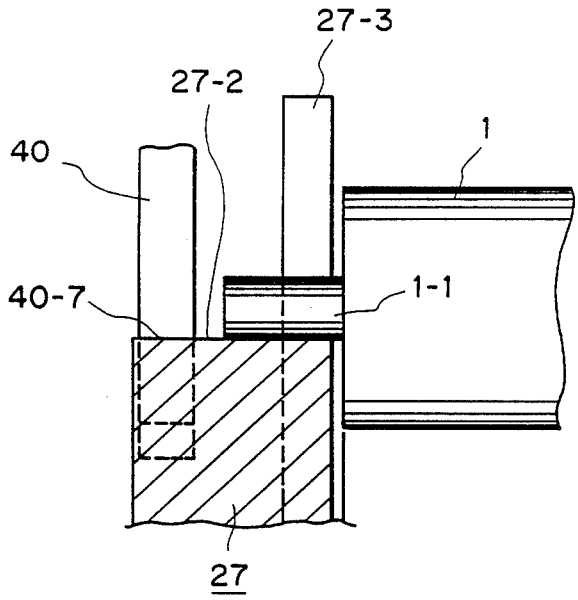
FIG. 8 is a sectional view taken along line Y—Y in FIG. 1.

Referring to FIGS. 1–4, an embodiment of the present invention will be described, wherein the same reference numerals as in FIG. 7 is assigned to the corresponding elements. Similarly to the conventional structure described hereinbefore, the image forming apparatus according to this embodiment is constituted by the three parts, A, B and C.

As regards the lower or bottom body F2, only the frame 26 and the transfer material conveying system from the sheet feeding station 21 on the frame 26 to the fixing device 25 are shown, and the other structure such as left and right side walls are omitted for simplicity, since they may be of a well known type.

Figure 1:
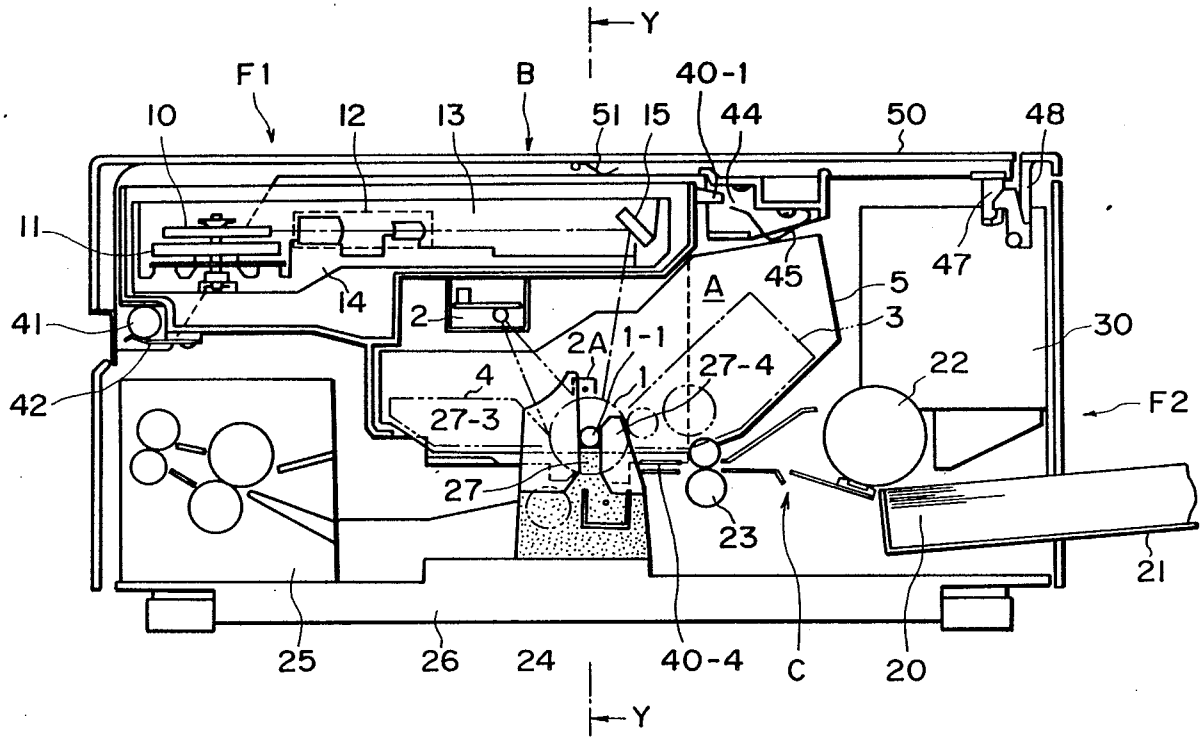
FIG. 1 is a sectional view of an image forming apparatus according to an embodiment of the present invention.
Figure 2:
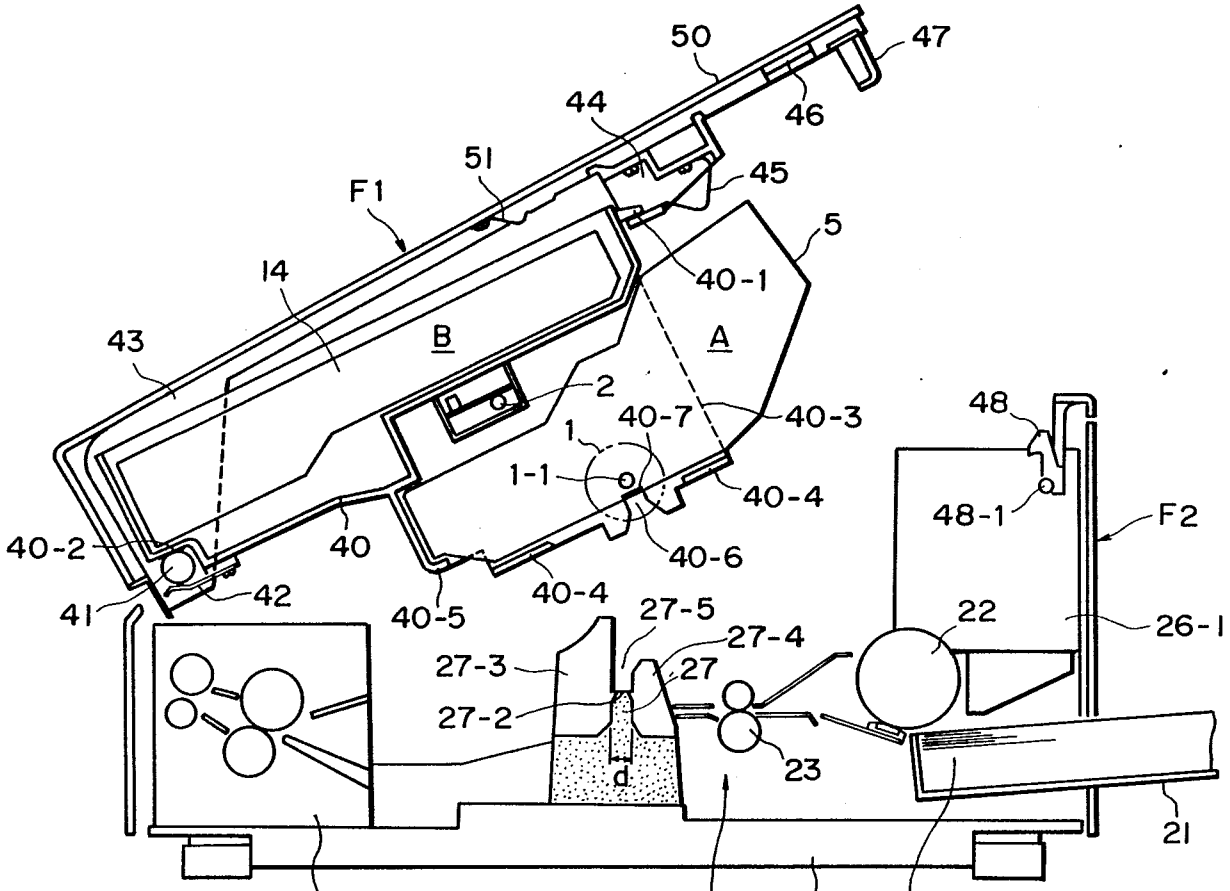
FIG. 2 is a sectional view of the same apparatus when the upper body is opened.
Figure 3:
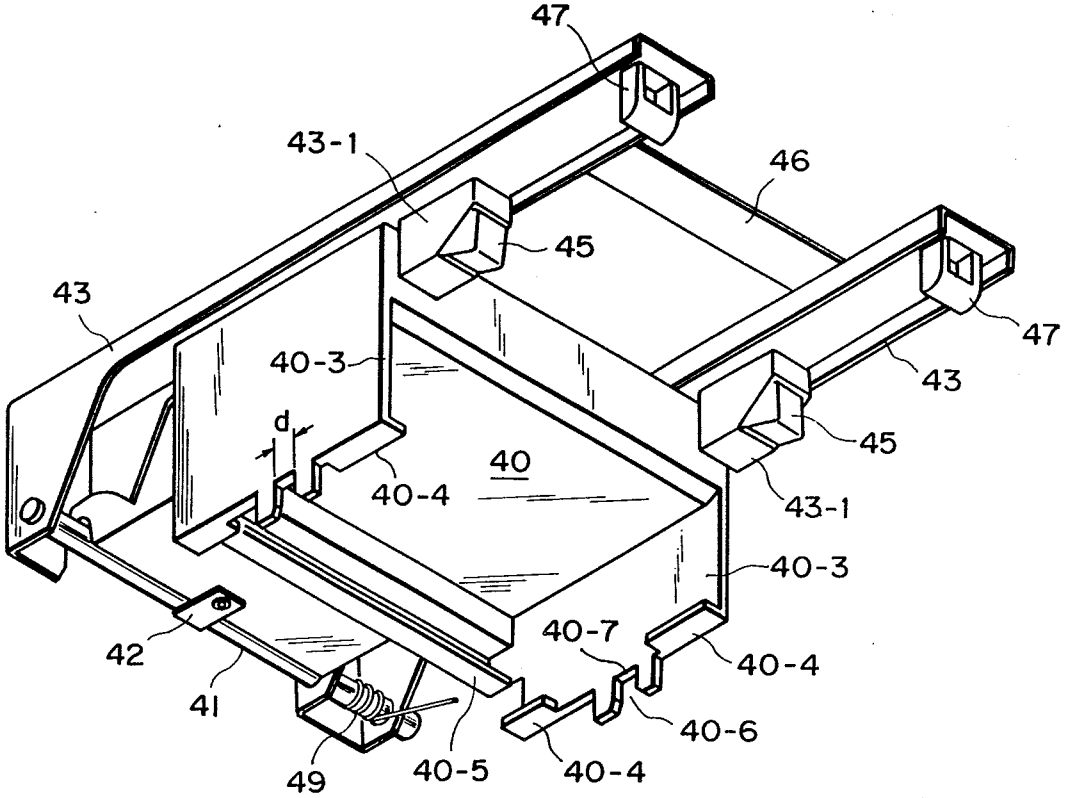
FIG. 3 is a perspective view of the upper body of the apparatus seen from bottom right.

The upper or first body F1 includes, as shown in FIGS. 1–3, right and left plate frames 43 connected by a stay 46 and a cover 50 at the top. The upper body F1 is openably mounted about a shaft 41 to the bottom or second body F2. Hooks 47 are mounted to the plate frame 43 at a shaft 41 side which will hereinafter be called rear side and at the opposite side which will hereinafter be called a front side. The hooks 47 are engageable with lever hooks 48 mounted on a frame 26-1 of the bottom body F1 to maintain the upper body F1 at its closed position shown in FIG. 1.

An optical system table is disposed at the back of the top body and is in the form of a dish which is similar to the bottom surface of the resin housing 14 of the optical system B, and a housing 14 is fixed thereabove. Stopper pins 40-1 are provided on the optical system table 40 at both sides at the front side, and are loosely inserted into a holder 43-1 mounted on the frame 43.

An L shaped recess is formed at a lower portion of the rear side of the optical system table 40, and a land 40-2 at the bottom surface of the horizontal portion thereof is placed on a shaft 41, and a leaf spring 42 is mounted adjacent a center of the optical system table 40 in the direction of the shaft 41, by which the shaft 41 is gripped with the land 40-2.

Therefore, the optical system table 40 having an optical system B mounted thereon is supported for free movement in the front-rear, left-right and up-down directions by left and right stopper pins 40-1 and a holder 43-1 at the front side, and by the land 40-2, the leaf spring 42 and the shaft 41 at the central portion at the rear side. Thus, the optical system table 40 is supported at three points.

A cartridge supporting shelf 40-3 has left, right and rear portions extending downwardly, and the cartridge 5 is inserted into the shelf 40-3 from the front side. The cartridge is placed on receiving edges 40-4 and 40-5 at the bottom end, so that the cartridge 5 is supported for free movement in the up-down, left-right and front-rear directions.

In the structure described above, when the closed apparatus is unlocked by operating the lever 48 to disengage it from hook 47, then the upper body is opened, as shown in FIG. 2, by a coil spring 49 (FIG. 3) wound on the hinge shaft 41. At this time, the optical system table 40 rotates about the shaft 41 by its own weight in the clockwise direction until the stopper 40-1 abuts the bottom surface of the holder 44. The cartridge pressing spring 45 mounted to the lower portion of the holder 44 is moved away from the cartridge 5, thus placing the process cartridge A under the condition of free demount.

When the upper body is closed from the state of FIG. 2 to the state of FIG. 1, the optical system table 40 and the process cartridge A are automatically positioned relative to the transfer material conveying section C, and the optical system table 40 and the cartridge A are locked by being pressed by the spring 51 and the spring 45, respectively.

The description will be made as to the positioning member.

Figure 4:
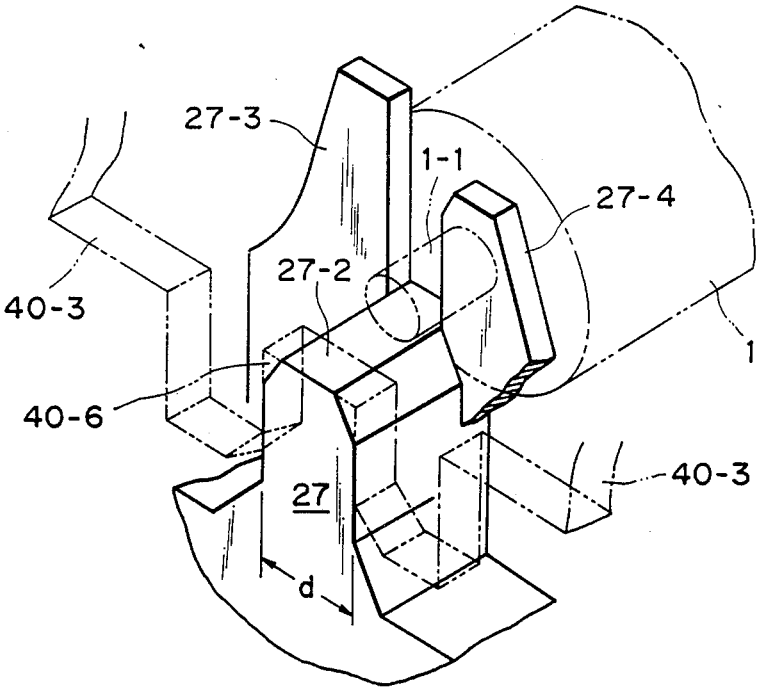
FIG. 4 is a perspective view of a positioning portion.

In FIGS. 1, 2 and 4, there are shown a positioning member which will hereinafter be called also "drum supporting base" and an engaging slot formed at the bottom surface of the cartridge supporting shelf 40-3 in opposition to the drum supporting base 27.

When the upper body F1 is closed, as shown in FIG. 1, the optical system supporting table 40 is moved by its own weight and the spring 51 until the top surface 40-7 of the engaging slot 40-6 abuts the top surface 27-2 of the drum supporting base 27. By forming a guiding taper portions on the top portion of the drum supporting base 27 and a lower part of the opening of the engaging slot 40-6 as shown in the Figure, the optical system B is self-adjusted to the correct position even if the optical system table is positionally deviated.

Simultaneously, the shaft 1-1 of the photosensitive drum 1 mounted at a correct position of the cartridge casing 5 is engaged with the engaging slot 27-5 between guiding projections 27-3 and 27-4 at both ends of the drum supporting base 27 and is abutted to the top surface 27-2 of the supporting base 27, so that the drum shaft 1-1 is correctly positioned.

Since both of the cartridge shelf 40-3 integral with the optical system table 40 and the drum shaft are abutted to a positioning surface, they are positioned correctly.

The drum supporting base 27 having the positioning portion is fixed to the frame with correct alignment with the transfer material conveying section C, particularly the transfer section.

Figure 5:
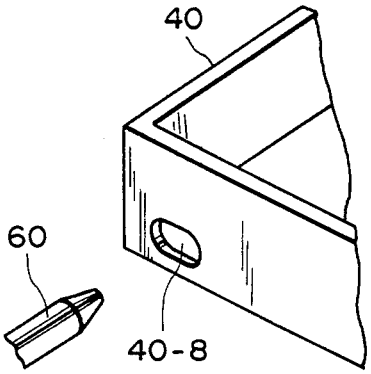
FIGS. 5 and 6 are perspective views of other examples for a table supporting mechanism.

Referring to FIG. 5, there is shown another example of the mounting structure for mounting the optical system table 40 to the plate frame 43 of the top body F1, which is constituted by the members 40-2 and 42 shown in FIG. 2. In this example, pins 60 are mounted to the plate frames 43 and 43 and are extended parallel to the shaft 41, and the pins 60 are loosely inserted into elongated holes 40-8 formed in the side walls of the optical system table 40.

Figure 6:
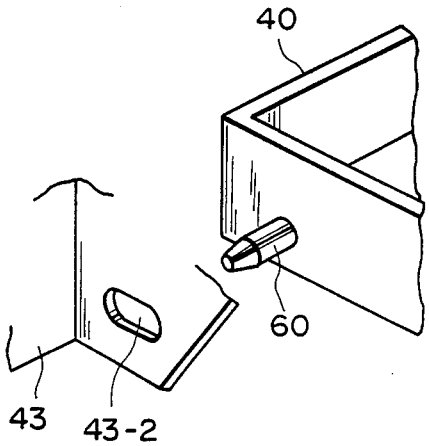

FIG. 6 shows a further example wherein pins 60 on the optical system table 40 are inserted into an elongated holes 43-2. Alternatively, the optical system table 40 may be dangled from the plate frame 43.

As a further alternative, the cartridge casing 5 may be retractably supported on the separate supporting frame, and the supporting frame may be accommodated on the optical system table 40 for free movement.

The projection-hole relationship may be reversed between the drum supporting base 27 of the transfer material conveying section and the engaging slot 40-6 of the optical system table 40. In the example shown in the Figure, the widths d of the drum supporting base 27 and the engaging slot 40-6 are made equal on a vertical line passing through the drum axis line. However, the portion of the drum supporting base 27 receiving the engaging slot 40-6 may have a width larger or smaller than the width d without significantly degrading the positional accuracy, and therefore, the similar effects can be provided.

In the foregoing embodiments, the positioning portion between the photosensitive drum 1 and the optical system table 40 is aligned with the axis of the photosensitive drum 1, but this is not limiting, and it may be away from the axis of the photosensitive drum 1 if the positional accuracy can be maintained.

The opening of the top body may be perpendicular to the direction of conveyance of the transfer material. In the foregoing embodiments, the laser beam printer has been used, but the present invention is applicable to a system wherein an LED array or a liquid crystal shutter array are used as the optical system B.

The process cartridge A may contain a photosensitive member and a developing device; a photosensitive member and a cleaning device; or a photosensitive member, a developing device and a cleaning device. The photosensitive member, the developing device and the cleaning device may be separable from the process cartridge if they are in effect a unit when located in the main assembly of the image forming apparatus.

As described in the foregoing, according to the present invention, the optical system and the process cartridge are mounted in the openable top body so that they are independently movable, and they are positioned relative to the transfer material conveying section when the top body is closed, by positioning the three constituent elements at adjacent positions, and therefore the positional accuracy of those elements is very high, by which the image quality and the printing quality are improved without difficulty.

Since the positioning portions are concentrated, the accuracies of the other parts such as the hinge, the holder of the cartridge may be relatively low, thus eliminating the necessity of a high accuracy, bulky, and therefore, the expensive block member used in the conventional apparatus, so that the cost can be decreased.

Also, the cartridge can be off-set relative to the upper body which is rotatable, and therefore, the mounting and demounting of the cartridge is easier, thus improving the operativeness.

Also since the optical system and the process cartridge are mounted into the upper body, the main assembly of the apparatus can be made smaller as compared with the conventional structure wherein the optical system is disposed in the lower body.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus including separable first and second portions and usable with a process cartridge detachably mountable into said image forming apparatus:

said first portion including, a first supporting portion for detachably mounting and movably supporting the process cartridge which contains a photosensitive member and process means actable on said photosensitive member, and a second supporting portion for movably supporting optical means for producing light information to be projected onto said photosensitive member; and said second portion of said image forming apparatus including.

first positioning means for supporting a positioning portion for said photosensitive member of the process cartridge, and second positioning means for supporting a positioning portion for said optical means.

2. An apparatus according to claim 1, wherein said first positioning means and said second positioning means are adjacent to each other.

3. An apparatus according to claim 1, wherein said second positioning means is abutted by a part of said optical means.

4. An image forming apparatus including separable first and second portions and usable with a process cartridge detachably mountable into said image forming apparatus:

said first portion including, a first supporting portion for detachably mounting and movably supporting the process cartridge which contains a photosensitive member and process means actable on said photosensitive member, and a second supporting portion for rotatably supporting optical means for producing light information to be projected onto the photosensitive member adjacent an axis about which said first portion and said second portion of said image forming apparatus are separable; and said second portion of said image forming apparatus including, a first positioning means for supporting a positioning portion for the photosensitive member of the process cartridge, and second positioning means for supporting a positioning portion for said optical means.

5. An apparatus according to claim 4 wherein said first positioning means and said second positioning means are adjacent to each other.

6. An apparatus according to claim 4, wherein said second positioning means is abutted by a part of said optical means.

7. An image forming apparatus including separable first and second portions and usable with a process cartridge detachably mountable into said image forming apparatus:

said first portion including, a first supporting portion for detachably mounting and movably supporting the process cartridge which contains a photosensitive member and process means actable on said photosensitive member, and a second supporting portion for rotatably supporting optical means for producing light information to be projected onto the photosensitive member adjacent an axis about which said first and second portions of said image forming apparatus are separable;

said second portion of said image forming apparatus including, first positioning means for supporting a positioning portion for the photosensitive member for the process cartridge, and second positioning means for supporting a positioning portion for said optical means; and said first portion of said image forming apparatus further including, means for urging the process cartridge to said first positioning means, and means for urging the optical means to said second positioning means.

8. An apparatus according to claim 7, wherein said second positioning means is abutted by a part of said optical means.

9. An image forming apparatus including separable first and second portions and usable with a process cartridge detachably mountable into said image forming apparatus:

said first portion including, a first supporting portion for detachably mounting and movably supporting the process cartridge which contains a photosensitive drum and process means actable on said photosensitive drum, and a second supporting portion for rotatably supporting optical means for producing light information to be projected onto the photosensitive drum adjacent an axis about which said first and second portions of said image forming apparatus are separable;

said second portion of said image forming apparatus including, first positioning means for supporting a positioning portion for the photosensitive drum of the process cartridge, and second positioning means for supporting a positioning portion for said optical means; and said first portion of said image forming apparatus further including, means for urging the process cartridge to said first positioning means, and means for urging the optical means to said second positioning means.

10. An apparatus according to claim 9, wherein said second positioning means is abutted by a part of the optical means.

11. An image forming apparatus including separable first and second portions and usable with a process cartridge detachably mountable into said image forming apparatus:

said first portion including, a first supporting portion for detachably mounting and movably supporting the process cartridge which contains a photosensitive drum and process means actable on said photosensitive drum, and a second supporting portion for movably supporting optical means for producing light information to be projected onto the photosensitive drum; and said second portion of said image forming apparatus including, first positioning means for supporting a rotational shaft of the photosensitive drum of the process cartridge, and second positioning means for supporting a positioning portion for said optical means.

12. An apparatus according to claim 11, wherein said first positioning means and said second positioning means are adjacent to each other.

13. An apparatus according to claim 11, wherein said second positioning means is abutted by a part of said optical means.

14. An image forming apparatus including separable first and second portions and usable with a process cartridge detachably mountable into said image forming apparatus:

said first portion including, a first supporting portion for detachably mounting and movably supporting the process cartridge which contains a photosensitive drum and process means actable on said photosensitive drum; and a second supporting portion for rotatably supporting optical means for producing light information to be projected onto the photosensitive drum at a position adjacent to an axis about which the first portion and the second portion of said image forming apparatus are separable;

said second portion of said image forming apparatus including, first positioning means for positioning a rotational shaft of the photosensitive drum of the process cartridge, and second positioning means for supporting a part of said second supporting portion for said optical means; and said first portion of said image bearing member further including, means for urging the process cartridge to said first positioning means, and means for urging the optical means to said second positioning means.

15. An image forming apparatus including separable first and second portions and usable with a process cartridge detachably mountable into said image forming apparatus:

said first portion including, a first supporting portion for detachably mounting and movably supporting the process cartridge which contains a photosensitive drum and process means actable on said photosensitive drum, and a second supporting portion for rotatably supporting optical means for producing light information to be projected onto the photosensitive drum at a position adjacent an axis about which the first portion and the second portion of said image bearing member are separable;

said second portion of said image forming apparatus including, first positioning means for supporting a rotational shaft of the photosensitive drum of the process cartridge, and second positioning means for supporting a part of said second supporting portion for said optical means; and said first portion of said image forming apparatus further including, means for urging the process cartridge to said first positioning means, and means for urging the optical means to said second positioning means.

16. An apparatus according to claim 15, wherein said optical means is a laser scanning device.

17. An apparatus according to claim 15, wherein said process means of said process cartridge contains a charger, a developing device and a cleaning device.

18. An image forming apparatus including separable first and second portions and usable with a process cartridge detachably mountable into said image forming apparatus:

said first portion including when it is separated from said second portion, a first supporting portion for detachably mounting and movably supporting the process cartridge which contains a photosensitive drum and process means actable on said photosensitive drum, and a second supporting portion for movably supporting optical means for producing light information to be projected onto the photosensitive drum; and said second portion of said image forming apparatus including, first positioning means for supporting a rotational shaft of the photosensitive drum of the process cartridge, and second positioning means for supporting a positioning portion for said optical means.

19. An image forming apparatus including separable first and second portions and usable with a process cartridge detachably mountable into said image forming apparatus, said first portion including, a first supporting portion for detachably mounting and movably supporting the process cartridge which contains a photosensitive drum and process means actable on said photosensitive drum;

a second supporting portion for movably supporting optical means for producing light information to be projected onto the photosensitive drum;

said second portion including, first positioning means for supporting a rotational shaft of the photosensitive drum of the process cartridge;

said first portion of said image bearing member further including, means for urging the process cartridge to said first positioning means; and means for urging the optical means to correctly position it.

20. An apparatus according to claim 1, 4, 7, 9, 11, 14, 18 or 19, wherein said process means of said process cartridge contains a charger, a developing device and a cleaning device.

21. An image forming apparatus including separable first and second portions and usable with a photosensitive member detachably mountable into said image forming apparatus, said first portion including, a first supporting portion for detachably mounting and movably supporting a photosensitive member, and a second supporting portion for movably supporting optical means for producing light information to be projected onto said photosensitive member; and said second portion of said image forming apparatus including, first positioning means for supporting a positioning portion for said photosensitive member, and second positioning means for supporting a positioning portion for said optical means.

22. An apparatus according to claim 1, 4, 7, 9, 11, 14, 18, 19 or 21, wherein said optical means is a laser scanning device.

23. An apparatus according to claim 1, 4, 7, 9, 11, 14, 15, 18 or 21, wherein said first positioning means and said second positioning means have a common positioning portion.

* * * * *

UNITED STATES PATENT AND TRADEMARK OFFICE

CERTIFICATE OF CORRECTION

PATENT NO. : 4,947,208

DATED : August 7, 1990

INVENTOR(S) : TERUO KOMATSU, ET AL.

It is certified that error appears in the above-identified patent and that said Letters Patent is hereby corrected as shown below:

IN [57] ABSTRACT

Line 6, "able" should read --ably--.

COLUMN 2

Line 19, "error," should read --error--.

COLUMN 4

Line 32, "taper portions" should read --taper portion--.

COLUMN 6

Line 11, "including." should read --including,--.
Line 46, "claim 4" should read --claim 4,--.

COLUMN 9

Line 24, "apparatus," should read --apparatus:--.

UNITED STATES PATENT AND TRADEMARK OFFICE

CERTIFICATE OF CORRECTION

PATENT NO. : 4,947,208

DATED : August 7, 1990

INVENTOR(S) : TERUO KOMATSU, ET AL.

It is certified that error appears in the above-identified patent and that said Letters Patent is hereby corrected as shown below:

COLUMN 10

Line 14, "apparatus," should read --apparatus:--.

Signed and Sealed this

Fourth Day of August, 1992

*Attest:*

*Attesting Officer*

DOUGLAS B. COMER

*Acting Commissioner of Patents and Trademarks*